United States Patent [19]

Hirsch

[11] 4,012,875

[45] Mar. 22, 1977

[54] OVERHEAD STRUCTURAL, FIRE EXTINGUISHING AND VENTILATING SYSTEM

[75] Inventor: Morti Hirsch, New York, N.Y.

[73] Assignee: Active Fire Sprinkler Corporation, Brooklyn, N.Y.

[22] Filed: Feb. 25, 1976

[21] Appl. No.: 661,311

[52] U.S. Cl. ..... 52/168; 52/220; 98/40 D; 239/209

[51] Int. Cl.[2] ..... E04B 1/92; E04B 5/48

[58] Field of Search ..... 52/168, 220; 98/40 D; 239/208, 209; 169/20, 41

[56] References Cited

UNITED STATES PATENTS

| | | | |
|---|---|---|---|
| 2,734,583 | 2/1956 | Milan | 52/220 |
| 2,809,074 | 10/1957 | McDonald | 52/168 |
| 3,104,060 | 9/1963 | Bricmont | 239/209 |
| 3,464,172 | 9/1969 | McGee, Jr. | 52/168 |
| 3,516,347 | 6/1970 | May | 98/40 D |
| 3,520,345 | 7/1970 | Lillibridge et al. | 52/168 |
| 3,714,884 | 2/1973 | Christiansen | 98/40 D |
| 3,837,405 | 9/1974 | Huddle | 52/168 |

*Primary Examiner*—Price C. Faw, Jr.
*Assistant Examiner*—Robert C. Farber
*Attorney, Agent, or Firm*—Charles E. Baxley

[57] ABSTRACT

This disclosure teaches a structural, fire extinguishing and ventilating system for use in building construction. Parallel joists have tubular lower chords through which fire extinguishing water is circulated and from which a perforated ceiling depends to form an upper enclosure for a room. Ventilating air ducts are positioned between the joists so that the ventilating air passes over the tubular lower chords in noncontact heat exchange relationship with the fire extinguisher water and the air then passes downward through the perforated ceiling to the room.

1 Claim, 4 Drawing Figures

OVERHEAD STRUCTURAL, FIRE EXTINGUISHING AND VENTILATING SYSTEM

BACKGROUND OF THE INVENTION

This invention pertains to self cooling fire resistant overhead structural joints used in building construction. The invention pertains also to sprinkler fire extinguishing systems and ventilating systems which may be integrated harmoniously with the fire resistant members so as to eliminate duplication of piping and to conserve ceiling depth.

Steel structural joists for support of floors, roofs and the like usually are quite strong under normal conditions, but when fire occurs and high temperatures are generated, these steel joists frequently sag and may cause entire buildings to collapse.

With modern hot air heating and integral air conditioning systems there is a demand for summer and winter ventilating which must blend harmoniously with structural and fire extinguishing systems without aggravating ceiling depths.

STATEMENT OF INVENTION

Mr. Hirsch has solved problems of the prior art in a novel, useful, unobvious and particularly facile way. Parallel joists are formed with tubular lower chords through which fire extinguishing water circulates and from which a perforated ceiling depends to form an upper enclosure for a room. Ventilating ducts are positioned between the joists so that ventilating air passes over the tubular lower chords in noncontact heat exchange relationship with the fire extinguishing water and the air then passes downward through the perforated ceiling to the room.

Accordingly one object of this invention is to provide an overhead structural system including joists which will not sag, bend or fail in the presence of high temperatures and which therefore are truly fire resistant.

Another object of this invention is to provide an overhead structural system of the character stated with an inexpensive fire extinguishing system requiring little additional piping from that of the lower chords of the joists.

Still another object of this invention is to provide an overhead structural system of the character stated which accommodates heating and ventilating ducts at no additional expenditure of ceiling depth.

Among other objects of this invention are to provide an overhead structural system of the character stated which comprises few and simple parts that are assembled readily, which provide a relatively light weight yet heavy load carrying capacity, which to a great extent is capable of being furnished prefabricated or readily assembled in situs, which is cheap to manufacture, which is capable of being fabricated in quantity production, and which is practical and economical to a high degree in use.

BRIEF DESCRIPTION OF DRAWING

The foregoing and other objects, features and advantages will be seen more fully from an accompanying drawing viewed in conjunction with a detailed description of a preferred embodiment. Throughout the figures of the drawing, like parts will be identified with the same numerals.

PREFERRED EMBODIMENT

Figure 1:
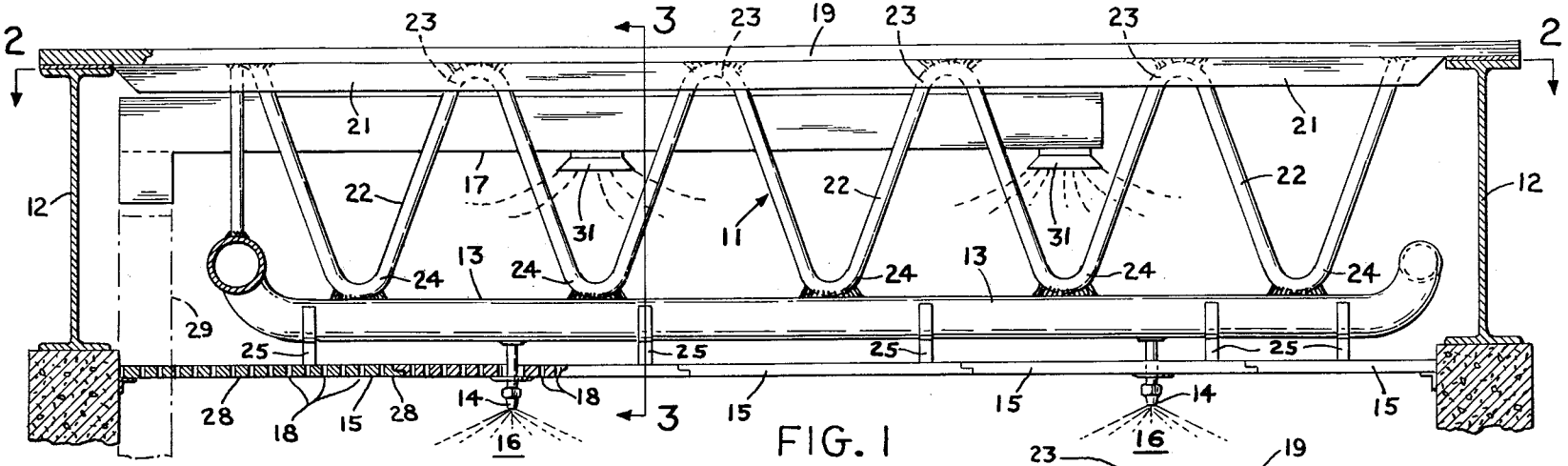
FIG. 1 is a side elevation view of an overhead structural, fire extinguishing and ventilating system in accordance with the present invention.
Figure 3:
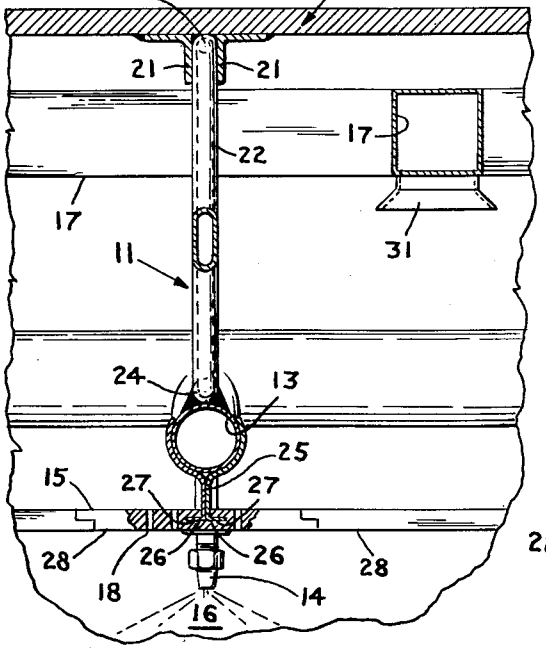
FIG. 3 is a partly broken sectional view taken along line 3—3 of FIG. 1.

As seen from the drawing an overhead structural, fire extinguishing and ventilating system for use in building construction in accordance with this invention includes generally a plurality of joists 11 which span between two girders 12 and which each have tubular lower chords 13 through which water for some fire sprinkler nozzles 14 circulates and from which a ceiling 15 is suspended to form an upper enclosure for a room 16. Ventilating air ducts 17 are positioned between the joists 11 and ventilating air on exiting the ducts 17 passes in noncontact heat exchange relationship with fire extinguishing water in the lower chords 13 and the ventilating air then passes downwardly through some perforations 18 in the ceiling 15 to the room 16.

The joists 11 generally are fabricated in a shop with an upper chord 19 which can be conventional such as a pair of structural angles 21 back to back sandwiching a web tube 22 which is organized in a generally serpentine configuration having upper bends 23 welded to the upper chord 19 and lower bends 24 welded to the lower chord 13. The depth of the joists 11 is determined generally by the spacing between the joists 11 and the loads to be imposed thereon. The tubular lower chord 13 must be designed for structural requirements and it must be adequate also to accommodate supply of water to the fire sprinkler nozzles 14. The joists may be supported from their upper chords 19 onto the girders 12 or they may be supported by means of their lower chords 13 as well.

Figure 4:
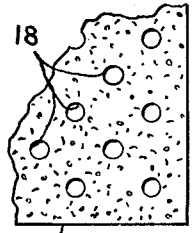
FIG. 4 is a fragmental top plan view of a perforated ceiling tile.

The ceiling 15 depends from the lower chord 13 by means of conventional straps 25 with flanges 26 to engage in grooves 27 of ceiling tiles 28. As best seen in FIG. 4, the tiles 28 are provided with a plurality of openings 18 through which the ventilating air passes to the room. The sprinkler nozzles 14 are connected in flow communication with the lower chords 13 and are heat actuated in a known manner.

Figure 2:
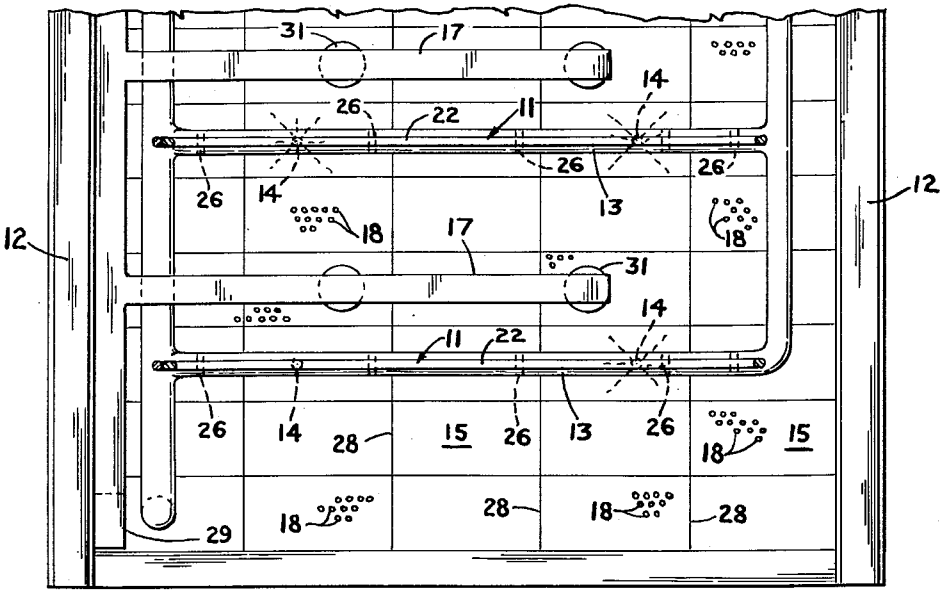
FIG. 2 is a top plan view taken along line 2—2 of FIG. 1.

The ventilating air ducts 17 are positioned, as best seen in FIG. 2, between the joists 11 and are connected as shown via an upcomer 29 to a source of heating or cooling ventilating air (not shown). Ventilating nozzles 31 are spaced along the ventilating air ducts 17 at suitable intervals to allow proper distribution of the ventilating air. It should be noted that under warm ambient conditions the generally cold water in the lower chord will reduce air conditioning requirements.

It will be apparent to those skilled in structural systems, heating, ventilating, air conditioning and fire sprinkling systems that wide deviations may be made from the described preferred embodiment without departing from a main theme of invention set forth in the following claims.

I claim:

1. An overhead structural fire extinguisher and ventilating system for use in building construction and comprising in combination:

a pair of spaced longitudinally extending girders, a plurality of longitudinally extending spaced parallel steel joists each spanning between the girders, each of the joists having an upper chord and a tubular lower chord with web members laced therebetween, a ceiling below and depending from the lower chord to form an upper enclosure for a room, means for circulating water through the tubular lower chord, fire sprinkler nozzles operatively connected to the lower chord and penetrating through the ceiling to the room, the fire sprinkler nozzles activated by heat, ventilating air ducts positioned between the joists and connected to a source of ventilating air, the ceiling provided with openings whereby the ventilating air passes from the ventilating air ducts in noncontact heat exchange relationship with the water in the lower chord and through the ceiling to the room, the web members comprising a tube with a generally serpentine configuration having upper bends welded to the upper chord and lower bends welded to the lower chord, the lower chords terminating in ports, pipes joining at least some of the ports in flow communication.

* * * * *

UNITED STATES PATENT AND TRADEMARK OFFICE

CERTIFICATE OF CORRECTION

PATENT NO. : 4,012,875

DATED : March 22, 1977

INVENTOR(S) : Morti Hirsch

It is certified that error appears in the above-identified patent and that said Letters Patent are hereby corrected as shown below:

In Column 1, line 7, delete [joints] and insert joists therefor.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*